US006971652B2

(12) United States Patent
Bobbert et al.

(10) Patent No.: US 6,971,652 B2
(45) Date of Patent: Dec. 6, 2005

(54) CONNECTING MECHANISM FOR PIVOTALLY CONNECTING A SHOE TO A SPORTING DEVICE

(75) Inventors: Maarten Bobbert, Amstelveen (NL); Gerrit de Groot, Haarlem (NL); Johannes Hendricus Petrus Houdjik, Amsterdam (NL); Jacobus Jozef de Koning, Langeraar (NL); Hans Meester, Leiden (NL); Albert Wilhelm Schreurs, Leiden (NL)

(73) Assignee: Viking Schaatsenfabriek B.V., (NL)

( * ) Notice: Subject to any disclaimer, the term of this patent is extended or adjusted under 35 U.S.C. 154(b) by 117 days.

(21) Appl. No.: 10/618,159

(22) Filed: Jul. 11, 2003

(65) Prior Publication Data

US 2004/0090022 A1 May 13, 2004

Related U.S. Application Data

(63) Continuation-in-part of application No. 10/002,263, filed on Nov. 2, 2001, now abandoned, which is a continuation of application No. pct/nl00/00289, filed on May 3, 2000.

(30) Foreign Application Priority Data

May 6, 1999 (NL) ..... 1011985

(51) Int. Cl.[7] ..... A63C 1/00

(52) U.S. Cl. ..... 280/11.27; 280/11.224; 280/11.12

(58) Field of Search ..... 280/11.12, 600, 280/11.15, 11.27, 11.28, 614, 615, 611, 613, 280/11.221, 11.224

(56) References Cited

U.S. PATENT DOCUMENTS

| | | | | |
|---|---|---|---|---|
| 4,322,091 | A * | 3/1982 | Storandt | 280/615 |
| 4,610,459 | A * | 9/1986 | Jungkind | 280/615 |
| 4,659,103 | A * | 4/1987 | Tessaro | 280/615 |
| 4,725,069 | A | 2/1988 | Stampacchia et al. | |
| 5,125,680 | A | 6/1992 | Bejean et al. | |
| 5,190,309 | A | 3/1993 | Spitaler et al. | |
| 5,503,413 | A * | 4/1996 | Belogour | 280/11.225 |
| 5,842,706 | A * | 12/1998 | Chang | 280/11.28 |

(Continued)

FOREIGN PATENT DOCUMENTS

CH 659 397 A5 12/1978

(Continued)

OTHER PUBLICATIONS

PCT Search Report.

(Continued)

*Primary Examiner*—Christopher P. Ellis
*Assistant Examiner*—Jeff Restifo
(74) *Attorney, Agent, or Firm*—Foley Hoag LLP

(57) ABSTRACT

Connecting mechanisms for pivotally coupling a shoe with a sporting device are described. In one embodiment, the connecting mechanism can include a support element for supporting a shoe, a connecting element disposed on a sporting device, and a coupling element for coupling the support element to the connecting element. The support element can include a first end liftably disposable on the sporting device and a second end spaced apart from the first end. The coupling element can include a first end attachable via a first pivot to the second end of the support element and a second end attachable via a second pivot to the connecting element. The first and second pivots can be active successively with the progression of a bending movement of a foot in a shoe supported by the support element.

16 Claims, 9 Drawing Sheets

U.S. PATENT DOCUMENTS

| | | | | |
|---|---|---|---|---|
| 6,007,075 | A | 12/1999 | Shum | |
| 6,017,050 | A * | 1/2000 | Girard | 280/615 |
| 6,039,329 | A | 3/2000 | Burns et al. | |
| 6,056,299 | A | 5/2000 | Soo | |
| 6,079,717 | A * | 6/2000 | Meester et al. | 280/11.12 |
| 6,082,744 | A | 7/2000 | Allinger et al. | |
| 6,113,111 | A | 9/2000 | Gierveld et al. | |
| 6,152,458 | A * | 11/2000 | Edauw et al. | 280/11.14 |
| 6,168,184 | B1 * | 1/2001 | Simonetti et al. | 280/615 |
| 6,193,243 | B1 * | 2/2001 | Johannes Meester et al. | 280/11.221 |
| 6,367,173 | B2 | 4/2002 | Lancon | |
| 6,390,493 | B1 * | 5/2002 | Hauglin | 280/615 |
| 6,481,726 | B2 | 11/2002 | Alfieri et al. | |
| 6,736,412 | B1 * | 5/2004 | Krah | 280/11.224 |
| 2002/0079658 | A1 * | 6/2002 | Bobbert et al. | 280/14.28 |

FOREIGN PATENT DOCUMENTS

| | | |
|---|---|---|
| NL | C 1008647 | 9/1999 |
| WO | WO 96/37269 | 11/1996 |

OTHER PUBLICATIONS

Novelty Search of National Type Completed with English Translation.

* cited by examiner

CONNECTING MECHANISM FOR PIVOTALLY CONNECTING A SHOE TO A SPORTING DEVICE

REFERENCE TO RELATED APPLICATIONS

This application is a continuation in part of U.S. patent application Ser. No. 10/002,263 filed on Nov. 2, 2001 now abandoned, which application is a continuation of International Patent Application Serial No. PCT/NL00/00289, filed on May 3, 2000, which application claims priority to Dutch Patent Application Serial No. 1011985, filed on May 6, 1999.

The contents of the above-identified Ser. No. 10/002,263 and PCT/NL00/00289 applications are expressly incorporated herein by reference.

FIELD

The subject matter described herein relates to a connecting mechanism for pivotally connecting a shoe to a sporting device, such as an ice skate, a roller skate, a ski, and other similar sporting devices.

BACKGROUND

A connecting mechanism is described in International Patent Application Serial No. PCT/NL96/00209 which corresponds to International Patent Application Publication No. WO 96/37269. The WO 96/37269 connecting mechanism focuses on an efficient transfer of forces from a thrusting foot to a sporting device. As described in WO 96/37269, it is not possible to realize an efficient transfer of forces with a simple construction. As such, the WO 96/37269 connecting mechanism includes a complicated construction. Such a complicated construction can make the connecting mechanism more susceptible to break-down. Also, the WO 96/37269 connecting mechanism lacks efficiency in transferring forces from a thrusting foot to a sporting device.

The WO 96/37269 connecting mechanism can include a sub-frame with different pivots for coupling a shoe to a sporting device. One of the pivots can be located near the front of the sporting device. The two different pivots allow a foot in a shoe to be released from the sporting device by rotating the foot and the shoe about the pivot near the front of the sporting device.

Swiss Patent CH-A5-659,397 describes a connecting mechanism having first and second pivots which, during use, can be successively active with the progression of a bending movement of a foot.

SUMMARY

It is an object of the claimed subject matter to provide a connecting mechanism that is not complicated, that inhibits break-down, that is simple to adjust, and that is capable of efficiently transferring thrusting forces from a bending foot to a sporting device.

Connecting mechanisms for pivotally coupling a shoe with a sporting device are described herein. In one embodiment, the connecting mechanism can include a support element for supporting a shoe, a connecting element disposed on a sporting device, and a coupling element for coupling the support element to the connecting element. The support element can include a first end liftably disposed on the sporting device and a second end spaced apart from the first end. The coupling element can include a first end attachable via a first pivot to the second end of the support element and a second end attachable via a second pivot to the connecting element. The first and second pivots can be successively active with the progression of a bending movement of a foot in a shoe supported by the support element. Potentially advantageously, such an arrangement can enhance the efficiency of a bending movement by allowing the bending movement of a foot during thrusting to be closely followed.

In one embodiment, the connecting mechanism can further include a means to set an axis of said second pivot at an oblique angle in relation to a longitudinal direction of the sporting device. Potentially advantageously, as a result of this oblique angle, in the course of being lifted off of the sporting device, the support element can rotate about an adjustable angle about a location near the first and second pivots and transversely to the longitudinal direction of the sporting device. Such an arrangement, during straightening of a thrusting leg and, in particular, during straightening of an ankle, can help to keep the sporting device, for example, an ice skate, in position on the ground, which can improve the efficiency of a thrusting movement.

In one aspect, the coupling element and the connecting element can each include two adjoining parts with matably curved contact surfaces facing each other and fitting together. The coupling parts and the connecting parts can move relative to one another for setting the orientation of the second pivot at an oblique angle in relation to the longitudinal direction of the sporting device.

In one embodiment, the connecting mechanism can further include a means for fixing the contact surfaces of the coupling parts and the connecting parts in a predetermined position and for fixing the orientation of the second pivot.

In one aspect, the first pivot, which can be active in a first stage of a bending movement of a foot, can be located substantially adjacent the ball of a foot which, during use, is inside a shoe connected to the connecting mechanism.

In one aspect, the second pivot, which can be active in a second and last stage of a bending movement of a foot, can be located substantially adjacent the front of a foot which, during use, is inside a shoe connected to the connecting mechanism.

In one aspect, the first and second pivots can be active in succession without being active simultaneously.

These and other features of the connecting mechanisms described herein can be more fully understood by referring to the following detailed description and accompanying drawings, in which similar parts in different drawings are labeled with the same reference numerals.

DETAILED DESCRIPTION

Figure 1:
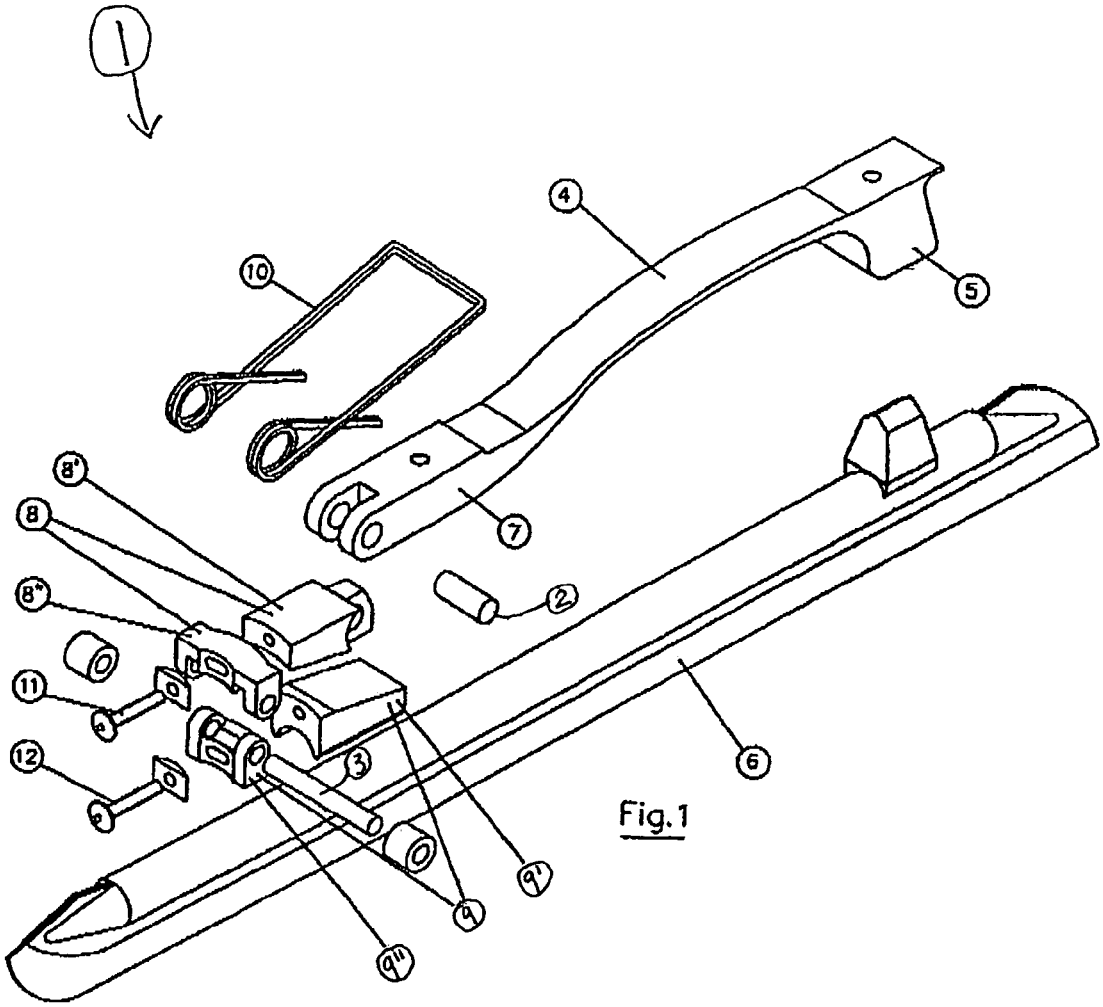
FIG. 1 shows an exploded view of an exemplary connecting mechanism disposed on an ice skate.

Illustrative embodiments will now be described to provide an overall understanding of the connecting mechanisms described herein. One or more examples of the illustrative embodiments are shown in the drawings. Those of ordinary skill in the art will understand that the systems and methods described herein can be adapted and modified to provide devices, methods, schemes, and systems for other applications, and that other additions and modifications can be made to the connecting mechanisms described herein without departing from the scope of the present disclosure. For example, aspects, components, features, and/or modules of the illustrative embodiments can be combined, separated, interchanged, and/or rearranged to generate other embodiments. Such modifications and variations are intended to be included within the scope of the present disclosure.

Figure 2:
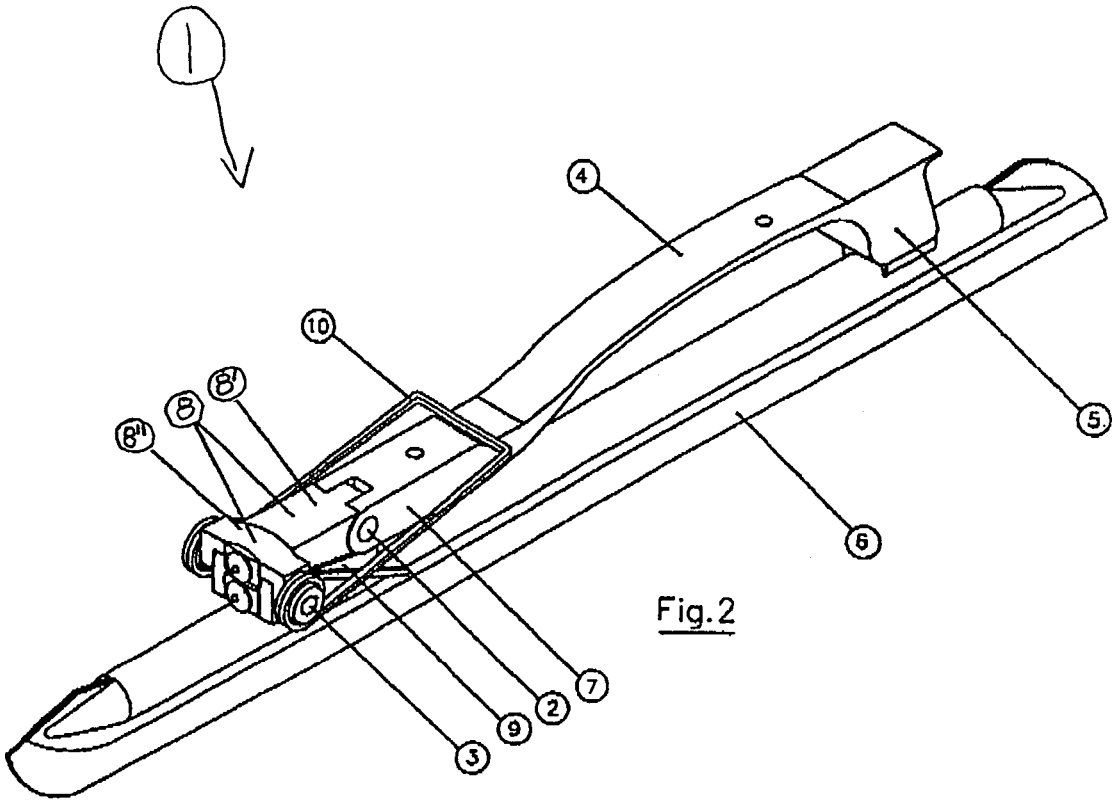
FIG. 2 shows an assembled view of the connecting mechanism of FIG. 1.

FIGS. 1 and 2 show an exemplary connecting mechanism. As shown in FIGS. 1 and 2, the connecting mechanism 1 can be connected to a sporting device 6, such as an ice skate. In the shown embodiment, the connecting mechanism 1 can include a support element 4 for supporting a shoe, a connecting element 9, a coupling element 8 for coupling the support element 4 to the connecting element 9, a first pivot 2, and a second pivot 3.

In one embodiment, the support element 4 can include a first end 5 and a second end 7 spaced apart from the first end 5. The first end 5 can be liftably disposed on the sporting device 6.

In one embodiment, the connecting element 8 can include a first end 8' and a second end 8". The first end 8' can be connected via the first pivot 2 to the second end 7 of the support element 4.

In one embodiment, the connecting element 9 can include a first end 9' and a second end 9". The first end 9' of the connecting element 9 can be attached, mounted, or otherwise disposed on the sporting device 6. The second end 9" of the connecting element 9 can be attached to the second end 8" of the coupling element 8 via the second pivot 3.

As shown in FIGS. 1 and 2, in one embodiment, the coupling element 8 can include two adjoining parts 8', 8" having matably curved contact surfaces which face each other and fit together and the connecting element 9 can include two adjoining parts 9', 9" having matably curved contact surfaces which face each other and fit together. These curved contact surfaces can allow the coupling parts 8', 8" and the connecting parts 9', 9" to move in relation to each other. The curved contact surfaces can thus allow the second pivot 3 to be set at an oblique angle with respect to the longitudinal direction of the sporting device 6. Potentially advantageously, adjusting the angle of the second pivot 3 can enhance the efficiency of a bending movement of a foot in a shoe disposed on the support element 4 because the support element 4, during straightening of a thrusting leg and, in particular, during straightening of an ankle, can rotate about a small angle about the second pivot 3 and transversely to the longitudinal direction of the sporting device 6.

In one embodiment, the connecting mechanism 1 can include fixing means for fixing the coupling parts 8', 8" and the connecting parts 9', 9" in a pre-determined position. For example, as shown. in FIGS. 1 and 2, the fixing means can include screws 11, 12. Adjusting the positions of the contact surfaces of the coupling parts 8', 8" and the connecting parts 9', 9" can fix the orientation of the second pivot 3 with respect to the longitudinal direction of the sporting device 6.

In one embodiment, the connecting mechanism 1 can include a torsion spring 10. As shown in FIG. 2, the torsion spring 10 can push the support element 4 (and a shoe disposed thereon) towards the sporting device 6 in an assembled connecting mechanism 1.

Figure 3:
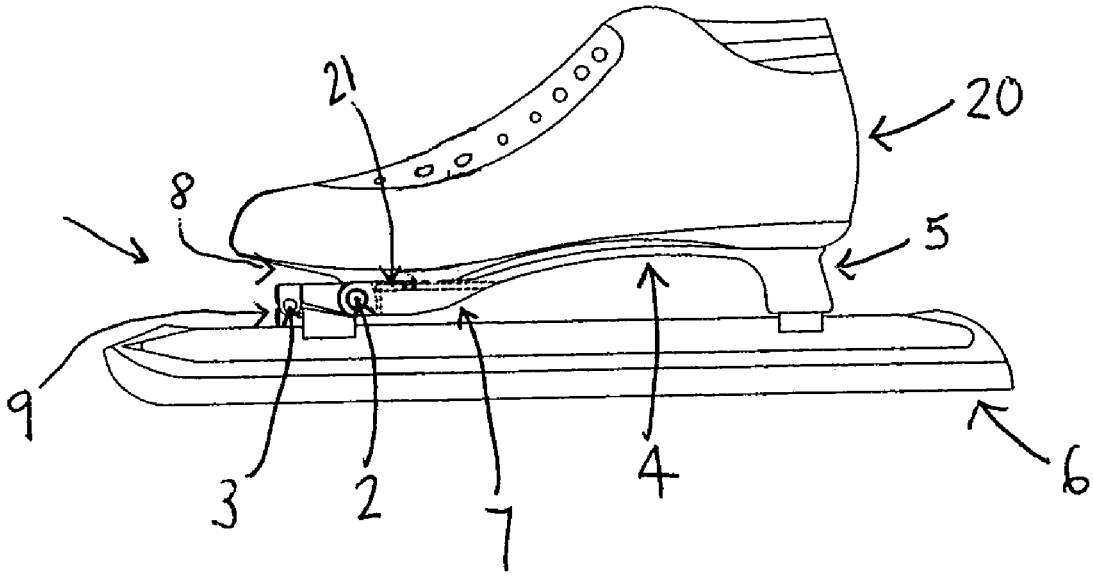
FIGS. 3–5 show side views of an exemplary connecting mechanism connecting a shoe to an ice skate, in which the connecting mechanism includes an adjustable stop disposed inside a support element.
Figure 4:
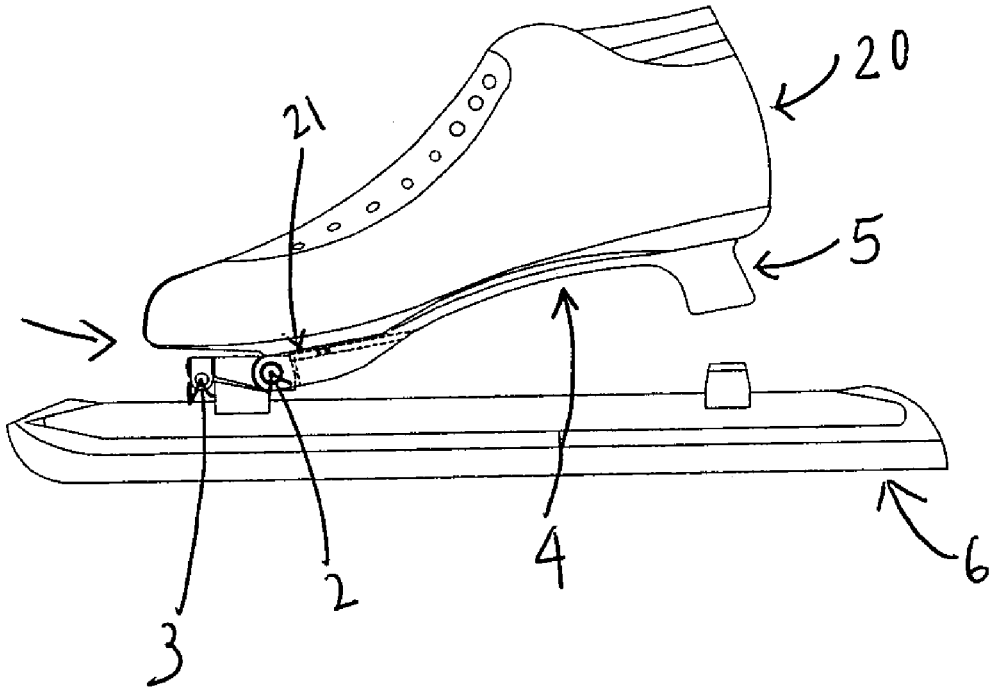
Figure 5:
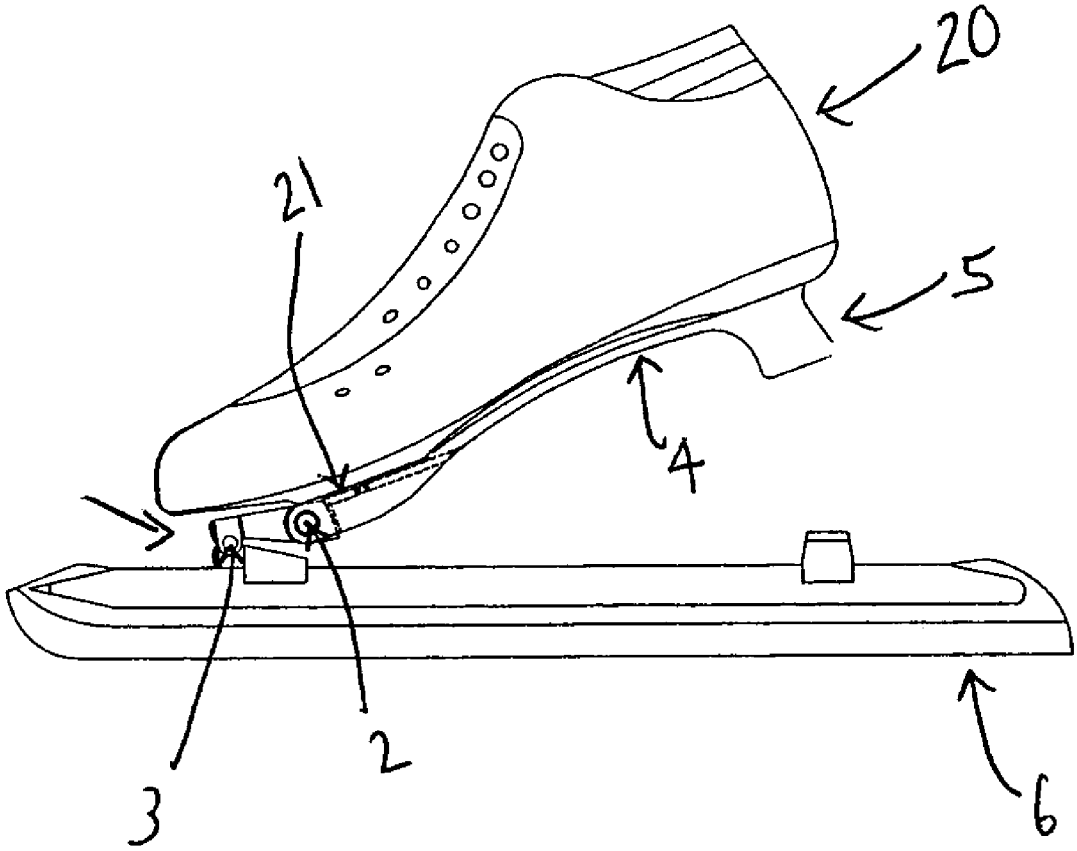
Figure 6:
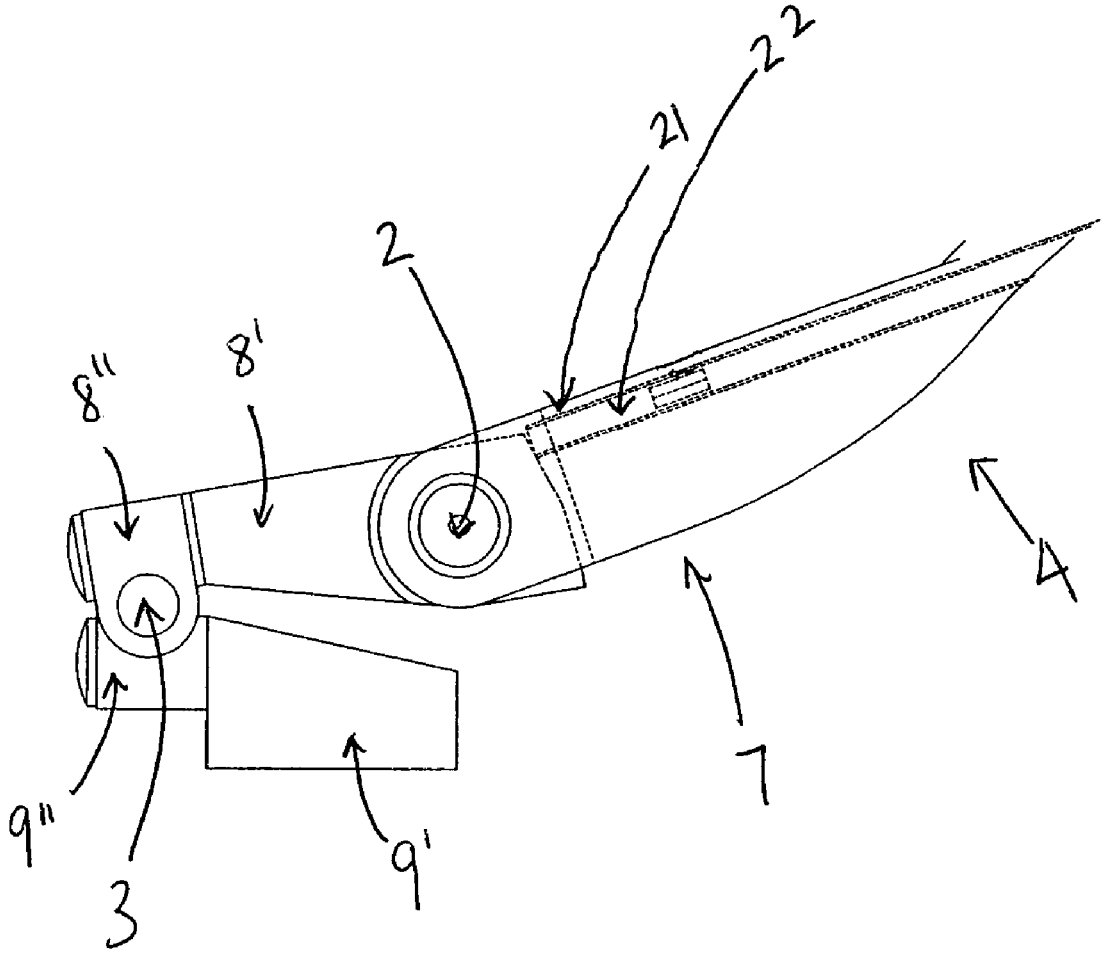
FIG. 6 shows a side view of the adjustable stop shown in FIGS. 3–5.
Figure 7:
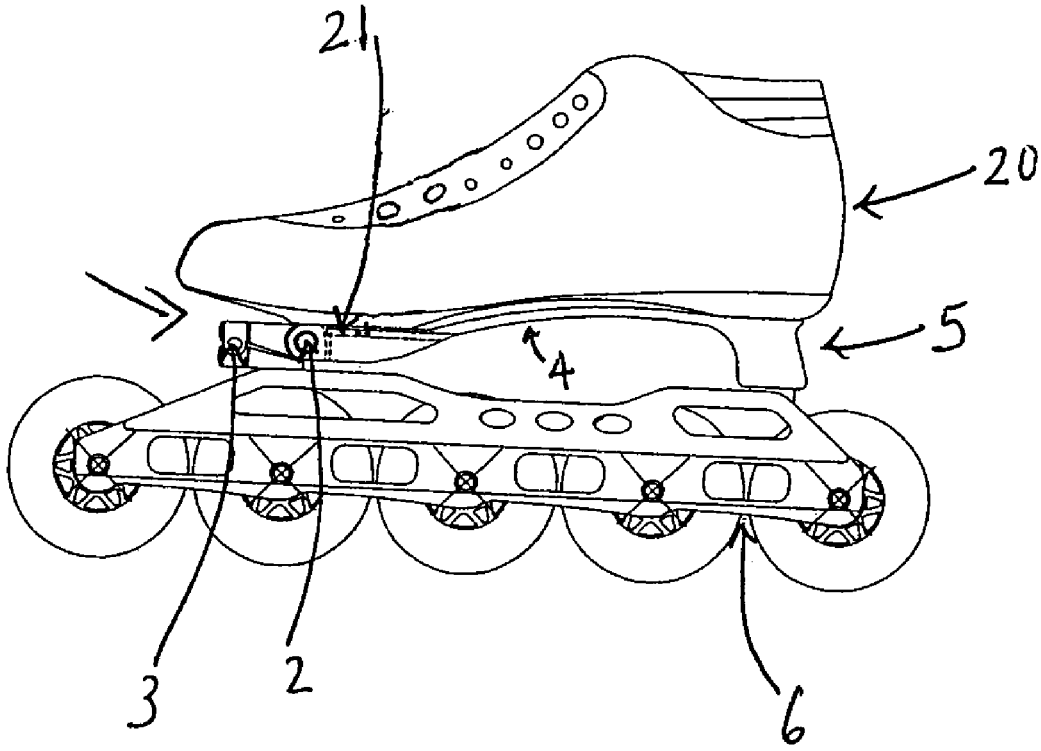
FIG. 7 shows a side view of an exemplary connecting mechanism connecting a shoe to a roller skate, in which the connecting mechanism includes the adjustable stop shown in FIGS. 3–6.

FIGS. 3–5 show progressive rotation of a shoe 20 disposed on a connecting mechanism 1 connected to an ice skate 6. In the shown embodiments, the first pivot 2 can be disposed substantially adjacent the ball of a foot disposed in the shoe 20 and the second pivot 3 can be disposed substantially adjacent the front of the foot. As shown in FIGS. 3–5, the first pivot 2 and the second pivot 3 can be successively active with the progression of a bending movement of a foot disposed inside the shoe 20. As shown in FIGS. 3 and 4, the first pivot 2 can be active in the first stage of thrust, i.e. the first part of a bending movement of the foot. As shown in FIG. 5, the second pivot 3 can be active in the second and last stage of thrust, i.e. the last part of the bending movement of the foot. Potentially advantageously, in the second and last stage, the second pivot 3 can be positioned so that the support element 4 forms an elongated lever. Such an arrangement can prolong contact between the ice skate 6 and an ice surface, thereby providing greater thrust efficiency.

As will be understood by those of ordinary skill in the art, regardless of whether the connecting mechanism 1 includes an adjustable stop as further described herein, the presence of the shoe 20 on the support element 4 can permit the first and second pivots 2, 3 to be successively active. As suggested in FIGS. 3–5, after an amount of upward rotation of the support element 4 about the first pivot 2, the shoe 20 can contact the coupling element 8 (i.e. one or both of the parts 8', 8"), thus inhibiting further rotation of the support element 4 about the first pivot 2. Subsequently, the support element 4 can continue to rotate upwardly about the second pivot 3.

As will also be understood by those of ordinary skill in the art, the connecting mechanism 1 can include an adjustable stop disposed on the support element 4 and/or the coupling element 8 to adjust the moment at which the second pivot 3 becomes active, which moment coincides with the moment at which the first pivot 2 completes its effect.

FIGS. 3–7 show an exemplary adjustable stop disposed on the support element 4. As shown, the adjustable stop 21 can include a tubular rod and can be secured at a desired position via a set screw 22. The adjustable stop 21 and the set screw 22 can be screwed into the support element 4 via a tubular hole having internal threads. The adjustable stop 21 and the set screw 22 can be removeably and replaceably attachable to each other. Alternatively, the adjustable stop 21 and the set screw 22 can be integrated to form one part.

Figure 8:
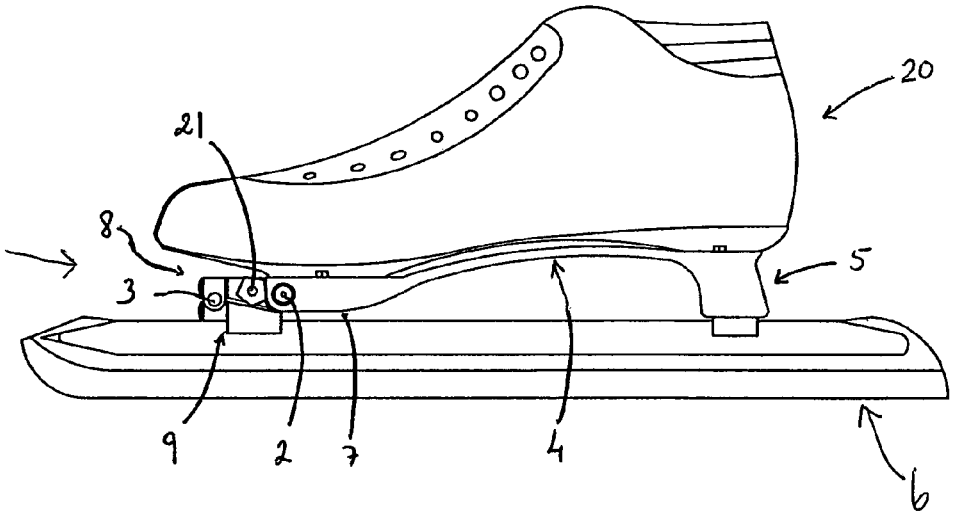
FIG. 8 shows a side view of an exemplary connecting mechanism connecting a shoe to an ice skate, in which the connecting mechanism includes an adjustable stop attached to a coupling element.
Figure 9:
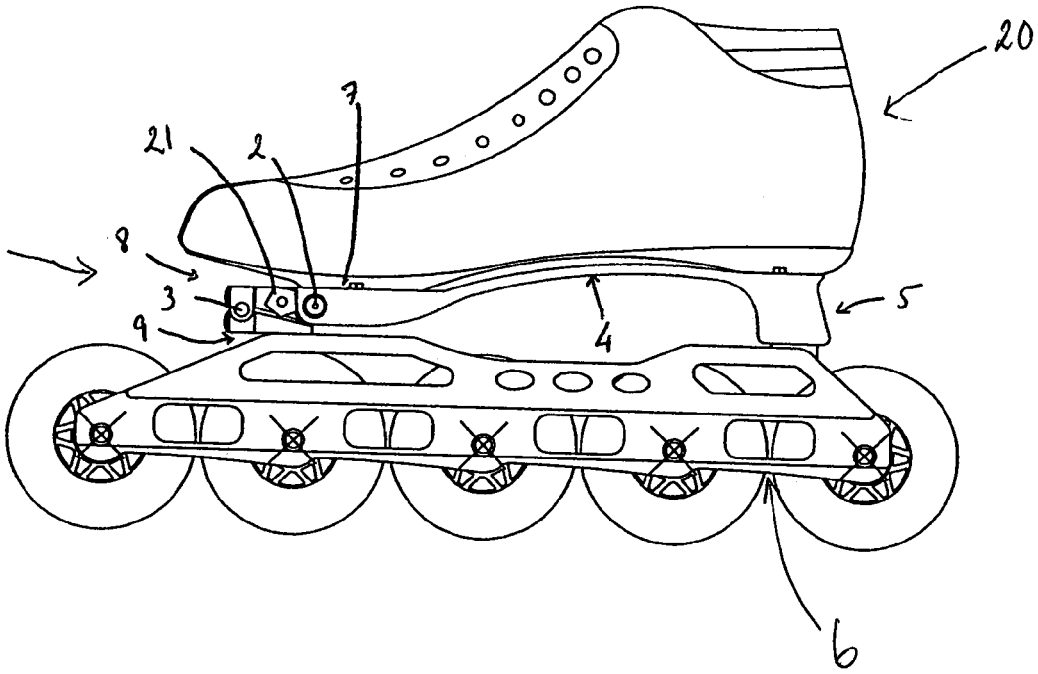
FIG. 9 shows a side view of an exemplary connecting mechanism connecting a shoe to a roller skate, in which the connecting mechanism includes the adjustable stop shown in FIG. 8.

FIGS. 8–9 show an exemplary stop disposed on the coupling element 8 (specifically, the coupling part 8'). As shown, the adjustable stop 21 can include a cam, with different sides of the cam having different distances to the center of the cam to allow the support element 4 to pivot to different angles.

While the connecting mechanisms described herein have been shown and described with reference to the shown embodiments, those of ordinary skill in the art will recognize or be able to ascertain many equivalents to the embodiments described herein by using no more than routine experimentation. Such equivalents are intended to be encompassed by the scope of the present disclosure and the appended claims.

For example, the connecting mechanisms described herein can be used with a variety of sporting devices, including, but not limited to, an ice skate, a roller skate, a ski, and other similar sporting devices.

Accordingly, the appended claims are not to be limited to the embodiments described herein, can comprise practices other than those described, and are to be interpreted as broadly as allowed under prevailing law.

What is claimed is:

1. A connecting mechanism for pivotally connecting a shoe to a sporting device, the connecting mechanism comprising:

a support element capable of supporting a foot of a user in the shoe, the support element including a first end and a second end spaced apart from the first end, the first end being liftably disposable on the sporting device, a connecting element being at least partially mountable on the sporting device, first and second pivots capable of being successively active when the support element is pivoted progressively from a substantially horizontal position in an upward direction about the first pivot, a coupling element for coupling the connecting element to the support element, the coupling element having a first end and a second end, the coupling element being connected at the first end via the first pivot to the second end of the support element, the coupling element being connected at the second end via the second pivot to the connecting element, and means for setting an axis of the second pivot at an oblique angle in relation to a longitudinal direction of the sporting device and for causing the support element to rotate in a direction perpendicular to the longitudinal direction of the sporting device in the course of being lifted off of the sporting device.

2. The connecting mechanism of claim 1, wherein the first pivot is configured to be disposed substantially adjacent a ball of a foot when disposed in the shoe and configured to be active in a first stage of a bending movement of the foot.

3. The connecting mechanism of claim 2, wherein the second pivot is configured to be disposed substantially adjacent a front of a foot when disposed in the shoe and configured to be active in a second and last stage of a bending movement of the foot.

4. The connecting mechanism of claim 1, wherein the coupling element includes two parts having matably curved contact surfaces, the connecting element includes two parts having matably curved contact surfaces, and the coupling parts and the connecting parts can be adjustably positioned for setting an axis of the second pivot in a predetermined position at an oblique angle in relation to a longitudinal direction of the sporting device.

5. The connecting mechanism of claim 4, further comprising:

means for fixing the coupling parts and connecting parts in the predetermined position.

6. The connecting mechanism of claim 5, wherein the means for fixing include screws.

7. The connecting mechanism of claim 1, wherein the sporting device includes one of an ice skate and a roller blade.

8. The connecting mechanism of claim 1, wherein a front direction is defined as the direction from the first end of the support element to the second end of the support element, and wherein the second pivot is disposed in front of the first pivot.

9. A connecting mechanism for pivotally connecting a shoe to a sporting device, the connecting mechanism comprising:

a support element capable of supporting a foot of a user in the shoe, the support element including a first and a second end spaced apart from the first end, the first end being liftably disposable on the sporting device, a connecting element being at least partially mountable on the sporting device, first and second pivots capable of being successively active when the support element is pivoted progressively from a substantially horizontal position in an upward direction about the first pivot, wherein the first pivot is the only connection between the support element and the other elements of the connecting mechanism, a coupling element for coupling the connecting element to the support element, the coupling element having a first end and a second end, the coupling element being connected at the first end via the first pivot to the second end of the support element, the coupling element being connected at the second end via the second pivot to the connecting element.

10. The connecting mechanism of claim 9, wherein the sporting device includes one of an ice skate and a roller blade.

11. A connecting mechanism for pivotally connecting a shoe to a sporting device, the connecting mechanism comprising:

a support element capable of supporting a foot of a user in the shoe, the support element including a first end and a second end spaced apart from the first end, the first end of the support element being liftably disposable on the sporting device, a connecting element being at least partially mountable on the sporting device, first and second pivots, a coupling element for coupling the connecting element to the support element, the coupling element having a first end and a second end, the coupling element being connected at the first end via the first pivot to the second end of the support element, the coupling element being connected at the second end via the second pivot to the connecting element, and an adjustable stop for limiting the rotation of the support element around the first pivot and causing the first and second pivots to be active in succession.

12. The connecting mechanism of claim 11, wherein the adjustable stop is coupled to one of the support element and the coupling element.

13. The connecting mechanism of claim 11, wherein the adjustable stop includes a cam attached to the coupling element.

14. The connecting mechanism of claim 11, wherein the adjustable stop includes a tubular rod disposed in a hole in the support element.

15. The connecting mechanism of claim 14, wherein the adjustable stop includes a set screw removeably and replaceably attachable to the tubular rod.

16. The connecting mechanism of claim 14, wherein the adjustable stop includes a set screw integral with the tubular rod.

* * * * *